US009834831B2

(12) United States Patent
Tobita et al.

(10) Patent No.: US 9,834,831 B2
(45) Date of Patent: Dec. 5, 2017

(54) HIGH RIGID SPHEROIDAL GRAPHITE CAST IRON

(71) Applicant: Kabushiki Kaisha Riken, Tokyo (JP)

(72) Inventors: Tomoyuki Tobita, Niigata (JP); Tadaaki Kanbayashi, Niigata (JP)

(73) Assignee: Kabushiki Kaisha Riken, Tokyo (JP)

( * ) Notice: Subject to any disclaimer, the term of this patent is extended or adjusted under 35 U.S.C. 154(b) by 196 days.

(21) Appl. No.: 14/380,846

(22) PCT Filed: Feb. 15, 2013

(86) PCT No.: PCT/JP2013/053685

§ 371 (c)(1),
(2) Date: Aug. 25, 2014

(87) PCT Pub. No.: WO2013/125464

PCT Pub. Date: Aug. 29, 2013

(65) Prior Publication Data

US 2015/0086410 A1 Mar. 26, 2015

(30) Foreign Application Priority Data

Feb. 24, 2012 (JP) ..... 2012-038160

(51) Int. Cl.

| | |
|---|---|
| ***C22C 37/04*** | (2006.01) |
| ***C22C 33/04*** | (2006.01) |
| ***C22C 33/08*** | (2006.01) |
| ***C22C 33/10*** | (2006.01) |
| ***C22C 37/10*** | (2006.01) |
| ***C22C 38/00*** | (2006.01) |
| ***C22C 38/02*** | (2006.01) |

(52) U.S. Cl.

CPC ..... *C22C 37/04* (2013.01); *C22C 33/04* (2013.01); *C22C 33/08* (2013.01); *C22C 33/10* (2013.01); *C22C 37/10* (2013.01); *C22C 38/002* (2013.01); *C22C 38/02* (2013.01)

(58) Field of Classification Search

CPC ..... C22C 37/04; C22C 37/10; C22C 33/04; C22C 33/08; C22C 38/002; C22C 38/02; C22C 38/10

See application file for complete search history.

(56) References Cited

U.S. PATENT DOCUMENTS

2009/0047164 A1* 2/2009 Menk ..... C22C 37/04 420/14

FOREIGN PATENT DOCUMENTS

| | | | |
|---|---|---|---|
| JP | H01-108343 | | 4/1989 |
| JP | 07145444 A | * | 6/1995 |
| JP | H08-295978 | | 11/1996 |
| JP | H10-96041 | | 4/1998 |
| JP | H10-317093 | | 12/1998 |
| JP | 2000-17372 | | 1/2000 |
| JP | 2001-3134 | | 1/2001 |
| JP | 2001-220640 | | 8/2001 |
| WO | WO 2013/125464 | | 8/2013 |

OTHER PUBLICATIONS

Kato, Shoji, English machine translation of JP 07-145444A, Jun. 1995, p. 1-8.*

Okada, Yuji, English machine translation of JP 2000-017372A, Jan. 2000, p. 1-11.*

International Search Report corresponding to PCT/JP2013/053685 dated May 7, 2013.

Notification of Transmittal of Translation of the International Preliminary Report on Patentability (Chapter I or Chapter II of the Patent Cooperation Treaty) corresponding to International Patent Application No. PCT/JP2013/053685 dated Sep. 4, 2014.

* cited by examiner

*Primary Examiner* — Roy King
*Assistant Examiner* — Caitlin Kiechle
(74) *Attorney, Agent, or Firm* — Jenkins, Wilson, Taylor & Hunt

(57) ABSTRACT

A high rigid spheroidal graphite cast iron, comprising: 2.0 mass % to less than 2.7 mass % or more than 3.0 mass % to less than 3.6 mass % of C, 1.5 to 3.0 mass % of Si, 1.0% or less of Mn, 1.0 mass % or less of Cu, 0.02 to 0.07 mass % of Mg and the residual Fe and inevitable impurities, wherein a carbon equivalent (a CE value) calculated by the mathematical expression (1): CE=C (mass %)+Si (mass %)/3 in terms of C and Si contents is 2.8 to 3.2% within a first range from 2.0 mass % to less than 2.7 mass % of C and is 3.6 to 4.2% within a second range from more than 3.0 mass % to less than 3.6 mass % of C, and the Young's modulus is 170 GPa or more.

8 Claims, 4 Drawing Sheets

[Fig.1]
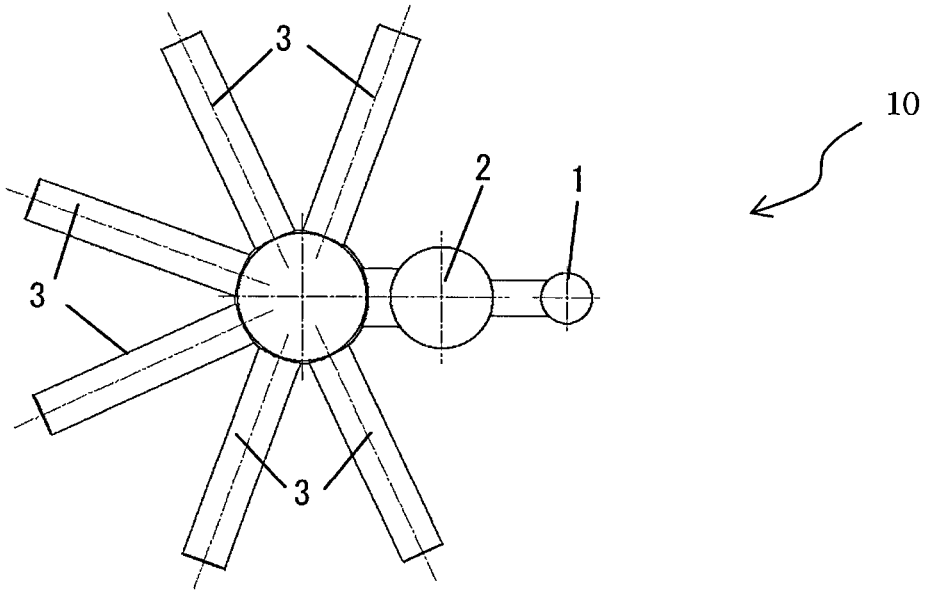

[Fig.2]
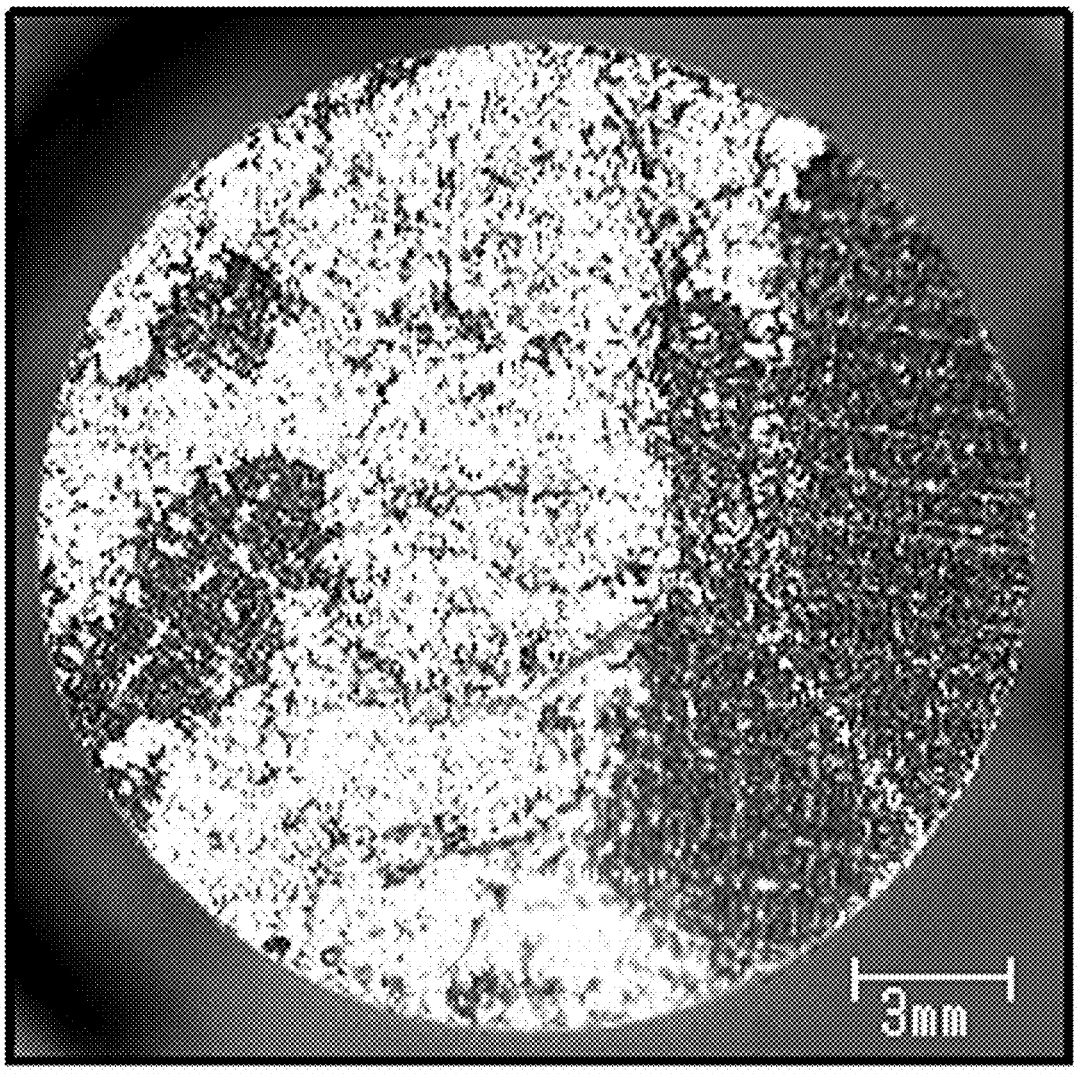
3mm

[Fig.3]
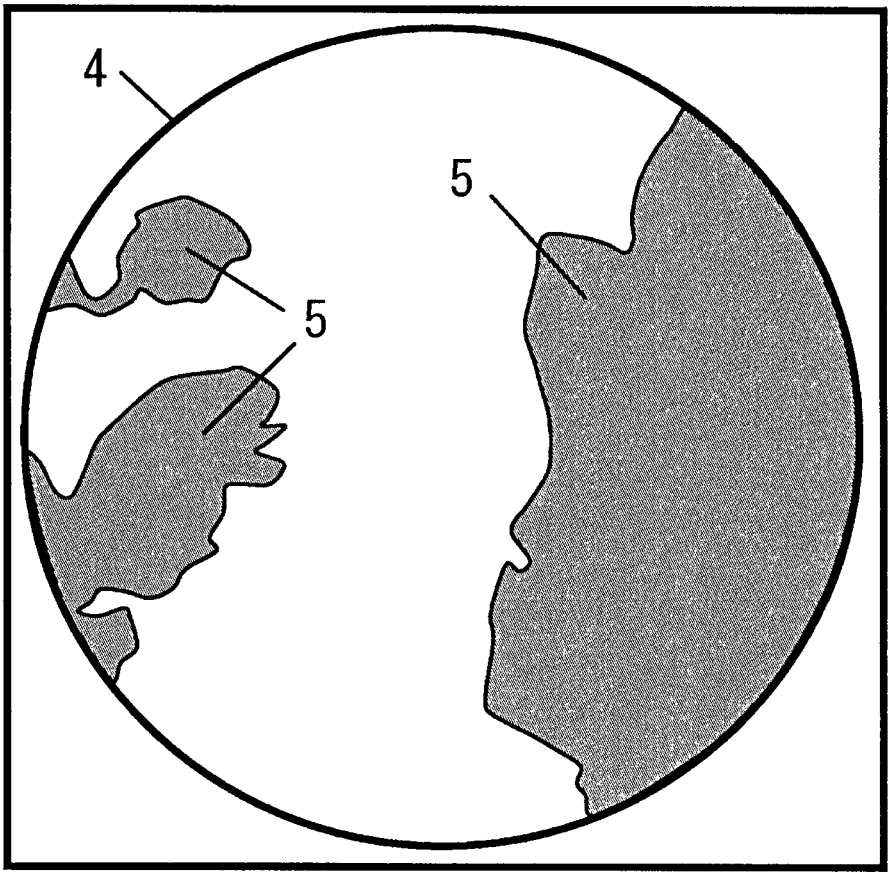

[Fig.4]
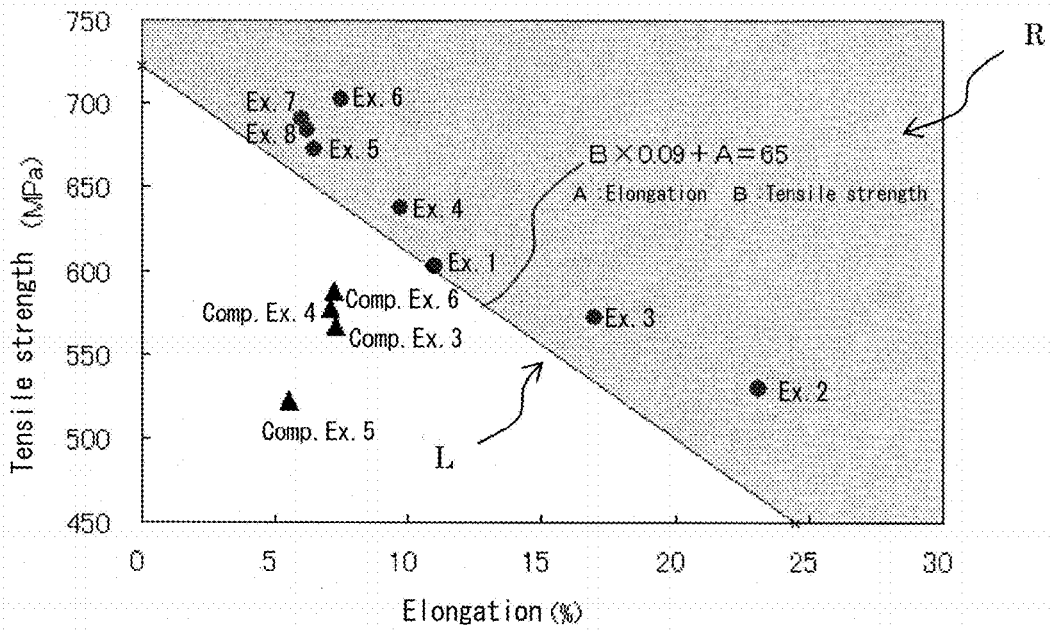

HIGH RIGID SPHEROIDAL GRAPHITE CAST IRON

FIELD OF THE INVENTION

The present invention relates to spheroidal graphite cast iron. More particularly, the present invention relates to high rigid spheroidal graphite cast iron suitably applied to vehicle parts such as undercarriage including a knuckle, a suspension arm and brake caliper and engine parts including a crank shaft, a cam shaft and a piston ring.

DESCRIPTION OF THE RELATED ART

In order to improve fuel efficiency and to respond environmental issues, lightweight vehicle parts are demanded. A high rigid material used for the parts is also needed. A variety of materials are used for the vehicle parts. Cast iron can be provided at low costs and can be shaped freely. Among others, spheroidal graphite cast iron has strength higher than flake graphite cast iron, and is frequently used for the vehicle parts. However, the spheroidal graphite cast iron generally used for the vehicle parts has an eutectic composition and the Young's modulus of about 165 GPa. Even if the spheroidal graphite cast iron is worked to have high strength, the Young's modulus is not changed. If the parts are thinned for light weight, rigidity cannot be held, thereby decreasing oscillation and noise characteristics. Therefore, for the vehicle parts focusing on high rigidity, cast steel having the Young's modulus higher than the cast iron is used. However, the cast steel has a casting temperature higher than the cast iron and has not good molten properties, which is difficult to be applied to a product having complex or a thin shape. Also, the cast steel may easily generate shrinkage cavities as compared to the cast iron. In order to prevent the shrinkage cavities, a casting system plan needs a great feeding head, which may increase the production costs. For the lightweight vehicle parts, high rigid spheroidal graphite cast iron is needed.

In order to provide the high rigid spheroidal graphite cast iron, it is needed to increase the Young's modulus. The Young's modulus is influenced by shape and crystallization amount of graphite in metal structure. When the graphite has a spheroidal shape and the crystallization amount is low, the Young's modulus becomes higher. When the spheroidal graphite cast iron is sufficiently spheroidized, a main factor affecting on the Young's modulus is the crystallization amount of graphite. Therefore, by decreasing a C content, a Si content and a carbon equivalent (a CE value) in a molten metal composition affecting on the crystallization amount of graphite, the crystallization amount of graphite is suppressed and the Young's modulus is increased for high rigidity. As such a technology, Patent Literature 1 proposes hypoeutectic spheroidal graphite cast iron including 1.5 to 3.0 mass % of C, which is a low C content, and 1.0 to 5.5 mass % of Si in order to increase the Young's modulus and rigidity. Patent Literature 2 proposes spheroidal graphite cast iron having a CE value of 3.4 to 4.0%, which is lower than the CE value of the eutectic composition (4.3%) in order to increase the Young's modulus and rigidity. Patent Literature 3 proposes spheroidal graphite cast iron having 2.7 to 3.0 mass % of C and a CE value of 3.6 to 3.9% in order to provide a graphite spheroidizing ratio of 80% or more.

[Patent Literature 1] Japanese Unexamined Patent Publication (Kokai) 2001-3134

[Patent Literature 2] Japanese Unexamined Patent Publication (Kokai) 2000-17372

[Patent Literature 3] Japanese Unexamined Patent Publication (Kokai) Hei 08-295978

Problems to be Solved by the Invention

When the C content and the CE value (the CE value of 4.3% where CE=C(%)+Si (%)/3) of the spheroidal graphite cast iron is lower than those of the eutectic composition, there is provided a hypoeutectic composition. Upon solidification of the composition, a primary crystal is austenite. Austenite is crystalized in the form of dendrite and the spheroidal graphite crystallized thereafter is easily linearly concatenated. Once this linear concatenated structures of the spheroidal graphite (concatenated structure of graphite) range in a wide area, mechanical properties may be degraded. In particular, the concatenated structure of graphite becomes a starting point of tensile fracture, which significantly lowers tensile strength and elongation.

However, it is not true that the concatenated structure of graphite of the spheroidal graphite cast iron is sufficiently studied in the related art. For example, the concatenated structures of graphite are significantly increased when the C content is 2.7% to 3.0% described in Patent Literature 3 (see Comparative Examples 3 to 6 in Table 1 of the present specification). If the spheroidal graphite cast iron is rigidified by decreasing the CE value of the spheroidal graphite cast iron lower than that of the eutectic composition, the tensile strength and the elongation are decreased by the concatenated structure of graphite. There is a problem that stable mechanical properties cannot be provided when the cast iron is applied to the vehicle parts focusing on the mechanical properties such as the tensile strength and the elongation.

The prevent invention solves the above-mentioned problem, and has an object to provide high rigid spheroidal graphite cast iron by decreasing a carbon equivalent (a CE value) and increasing the Young's modulus.

SUMMARY OF THE INVENTION

In order to solve the above-mentioned problems, through intense studies by the present inventors, it has been found that spheroidal graphite cast iron can have high rigidly by decreasing a carbon equivalent (a CE value) and increasing the Young's modulus. In addition, when the area ratio of the concatenated structure of graphite is controlled to 50% or less, both of the tensile strength and the elongation are improved and stable mechanical properties are provided.

In other words, the high rigid spheroidal graphite cast iron of the present invention comprises 2.0 mass % to less than 2.7 mass % or more than 3.0 mass % to less than 3.6 mass % of C, 1.5 to 3.0 mass % of Si, 1.0% or less of Mn, 1.0 mass % or less of Cu, 0.02 to 0.07 mass % of Mg and the residual Fe and inevitable impurities, wherein a carbon equivalent (a CE value) calculated by the mathematical expression (1): CE=C (mass %)+Si (mass %)/3 in terms of C and Si contents is 2.8 to 3.2% within a first range from 2.0 mass % to less than 2.7 mass % of C and is 3.6 to 4.2% within a second range from more than 3.0 mass % to less than 3.6 mass % of C, and the Young's modulus is 170 GPa or more.

In this way, by specifying the content of C and the range of the CE value, the concatenated structure of graphite is decreased, thereby providing a high rigid spheroidal graphite cast iron having the Young's modulus of 170 GPa or more.

If the area ratio of the concatenated structure of graphite exceeds 50%, the concatenated structure of graphite becomes a starting point of fracture before the tensile strength and the elongation inherent to the material is gained, which significantly lowers the tensile strength and the elongation.

Therefore, the area ratio of the concatenated structure of graphite is preferably 50% or less for improving both of the tensile strength and the elongation and providing stable mechanical properties.

Furthermore, when the mathematical expression (2): $0.09 \times B + A > 65$ (where A denotes elongation at fracture (%) and B denotes tensile strength (MPa)) is satisfied, the area ratio of the concatenated structure of graphite is preferably 50% or less, thereby improving both of the tensile strength and the elongation.

Effects of the Invention

According to the present invention, there is provided high rigid spheroidal graphite cast iron by decreasing a carbon equivalent (a CE value) and increasing the Young's modulus.

BRIEF DESCRIPTION OF THE DRAWINGS

[FIG. 1] A top view showing a beta set mold having cavities for producing the embodiment.

[FIG. 2] A view showing a microscope image of a fracture surface of a tensile test piece.

[FIG. 3] A schematic view clearly showing concatenated structure of graphite shown in FIG. 2.

[FIG. 4] A graph showing a relationship between tensile strength and elongation in each of Examples and Comparative Examples.

DESCRIPTION OF THE PREFERRED EMBODIMENTS

Hereinafter, embodiments according to the present invention will be described. In the context of the present invention, "%" denotes "mass(weight) %" unless otherwise specified.

The high rigid spheroidal graphite cast iron according to the embodiment of the present invention comprises 2.0 mass % to less than 2.7 mass % or more than 3.0 mass % to less than 3.6 mass % of C, 1.5 to 3.0 mass % of Si, 1.0% or less of Mn, 1.0 mass % or less of Cu, 0.02 to 0.07 mass % of Mg and the residual Fe and inevitable impurities, where a carbon equivalent (a CE value) calculated by the mathematical expression (1): CE=C (mass %)+Si (mass %)/3 in terms of C and Si contents is 2.8 to 3.2% within a first range from 2.0 mass % to less than 2.7 mass % of C and is 3.6 to 4.2% within a second range from more than 3.0 mass % to less than 3.6 mass % of C, and the Young's modulus is 170 GPa or more.

<Composition>

C (carbon) is an element for forming a graphite structure. In order to increase rigidity and the Yong's modulus of the spheroidal graphite cast iron, a crystallization amount of graphite has to be suppressed by decreasing the C content lower than the eutectic composition. However, if the C content is less than 2.0%, a start temperature of solidification becomes high, graphite is difficult to be crystallized and castability becomes worse, which may result in molten metal flow defects on parts having a thin or a complex shape, and shrinkage cavities on thick parts, for example. On the other hand, when the C content exceeds 3.6%, the crystallization amount of graphite is increased, and the Young's modulus is decreased. In addition, if the C content is in a range from 2.7% to 3.0%, the concatenated structure of graphite is significantly increased. Accordingly, the C content is set to 2.0% to less than 2.7% (hereinafter referred to as a first range, as appropriate) or more than 3.0% to less than 3.6% (hereinafter referred to as a second range, as appropriate).

Si is an element for facilitating crystallization of graphite. If the Si content is less than 1.5%, graphite is difficult to be crystallized, which may result in free cementite (chill) to significantly decrease workability. On the other hand, if the Si content exceeds 3.0%, ferrite is embrittled to decrease an impact value in mechanical properties. Accordingly, the Si content is set to 1.5% to 3.0%.

Mn is an element for stabilizing a pearlite structure. If the Mn content is high, a pearlite ratio in base structure is increased and tensile strength is increased. However, the effect is saturated if the content exceeds 1.0%. Accordingly, the Mn content is set to 1.0% or less.

Cu is an element for stabilizing a pearlite structure. If the Cu content is high, a pearlite ratio in base structure is increased and tensile strength is increased. However, the effect is saturated if the content exceeds 1.0%. Accordingly, the Cu content is set to 1.0% or less.

If the Mn and Cu contents are decreased, the tensile strength is not so improved, but ductility is improved. Accordingly, in order to improve the tensile strength to some degree and improve the ductility, the lower limit of Mn is preferably more than 0% and 0.3% or less, and the lower limit of Cu is preferably more than 0% and 0.3% or less. Depending on the thickness of the product, the pearlite ratio is changed even if additive amounts of Mn and Cu are not changed. The lower limits of the additive amounts of Mn and Cu are changed within the above-described ranges depending on the thickness of the product.

Mg is an element for affecting spheroidizing of graphite. A residual amount of Mg is an indicator for determining spheroidizing of graphite. If the residual amount of Mg is less than 0.02%, a graphite spheroidizing ratio is decreased and the Young's modulus is also decreased. On the other hand, if the residual amount of Mg exceeds 0.07%, shrinkage cavities and chill may be easily generated. Accordingly, the Mg content is set to 0.02 to 0.07%.

When the high rigid spheroidal graphite cast iron is applied to vehicle parts focusing on high strength, amounts of Mn and Cu that are elements for pearlite growth are increased to the upper limit defined as above (for example, 1.0%, respectively) similar to the spheroidal graphite cast iron in the related art. Thus, the pearlite within base structure is grown to provide the high rigid spheroidal graphite cast iron having high strength. When the high rigid spheroidal graphite cast iron is applied to vehicle parts focusing on ductility, amounts of Mn and Cu that are elements for pearlite growth are decreased to the lower limit defined as above. Thus, the high rigid spheroidal graphite cast iron having high ductility can be provided. The elements for pearlite growth can be Sn and the like other than Mn and Cu.

As the high rigid spheroidal graphite cast iron according to the present invention has a hypoeutectic composition, chill may be easily generated as compared to the spheroidal graphite cast iron having the eutectic composition. In order to suppress the generation of chill, an inoculant such as ferrosilicon is preferably added upon casting. An inoculation method can be selected from ladle inoculation, pouring inoculation and in-mold inoculation depending on the shape, the thickness, etc. of the product. The inoculant can be commercially available ferrosilicon inoculants containing Si. The inoculant may contain Bi, Ba, Ca, RE (rear earths) or the like effective to suppress chilling and refining spheroidal graphite.

When the inoculant is added to the high rigid spheroidal graphite cast iron according to the present invention, no chilling is generated and sufficient mechanical properties can be provided, even though no heat treatment is applied after casting. In this way, the productivity and the production costs can be improved as compared to the spheroidal graphite cast iron having the eutectic composition that requires the heat treatment after casting.

<CE Value>

As described above, the C content and the CE value are decreased lower than those in the eutectic composition, a primary crystal is austenite upon solidification. The primary crystal of austenite is increased as the C content and the CE value get decreased. Accordingly, the concatenated structure of graphite subsequently crystallized emerges widely as the C content and the CE value get decreased. Once the concatenated structure of graphite exceeds a certain ratio, that becomes a starting point of tensile fracture. Fracture is induced before the tensile strength inherent to the material is gained. Thus, the tensile strength and elongation are significantly lowered and no stable material properties can be provided.

Specifically, when the CE value is decreased under the eutectic composition (about 4.3%) to exceed 3.2% and be less than 3.8%, the concatenated structure of graphite appears on a fracture surface of a tensile test piece.

Within the CE range of 3.2 to 2.9%, no concatenated structure of graphite is recognized on the fracture surface of the tensile test piece. This may be because primary crystal of austenite is increased as the CE value is decreased within the CE range of 3.2 to 2.9%, but the crystallization amount of spheroidal graphite is decreased to decrease the density of the spheroidal graphite, whereby no concatenated structure of graphite is generated.

In addition, if the CE is less than 2.9%, the concatenated structure of graphite is again generated. It is contemplated that the concatenated structure of graphite is generated by the increase in the crystallization amount of the primary crystal of austenite rather by the decrease in the spheroidal graphite.

If the area ratio of the concatenated structure of graphite exceeds 50%, the concatenated structure of graphite becomes a starting point of fracture before the tensile strength and the elongation inherent to the material is gained. Thus, the tensile strength and the elongation are significantly lowered.

Therefore, in order to eliminate the impact on the tensile strength and the elongation, the area ratio of the concatenated structure of graphite is set to 50% or less and the CE value range is set to the first range of 2.8 to 3.2% and the second range of 3.6 to 4.2%.

As described above, by setting the C content and the CE value range, the high rigid spheroidal graphite cast iron having the Young's modulus of 170 GPa or more can be provided. The higher the Young's modulus is, the lighter the weight is. It is preferable that the Young's modulus be 175 GPa or more.

In addition, it is preferable that casting is performed within the CE range of 2.9 to 3.2% and 3.8 to 4.2% where no concatenated structure of graphite emerges. In particular, the CE range of 2.9 to 3.2% is desirable in that no concatenated structure of graphite emerges and the Young's modulus is 180 GPa or more.

If the area ratio of the concatenated structure of graphite exceeds 50% as described above, the concatenated structure of graphite becomes a starting point of fracture before the tensile strength and the elongation inherent to the material is gained. Thus, the tensile strength and the elongation are significantly lowered. Here, as shown in FIG. 4, as the tensile strength is increased, the elongation (elongation at fracture) is decreased. In order to provide the both, it is preferable that the values of the tensile strength and the elongation at fracture are controlled within a region R at an upper side of a diagonally right down line L shown in FIG. 4. Derivation of a relational expression of the line L will be described later. The region R satisfies the mathematical expression (2): $0.09 \times B + A > 65$ (where A denotes elongation at fracture (%) and B denotes tensile strength (MPa)).

In this way, when the area ratio of the concatenated structure of graphite is suppressed to 50% or less, the tensile strength and the elongation can be controlled within the region R (the mathematical expression (2)), thereby improving both of the tensile strength and the elongation to provide stable mechanical properties.

In particular, when $0.09 \times B + A > 68$ is satisfied, the area ratio of the concatenated structure of graphite becomes 0 (zero) %, which is more preferable in that a balance between the tensile strength and the elongation is the best.

According to the present invention, when the area ratio of the concatenated structure of graphite is set to 50% or less, the balance between the tensile strength and the elongation is excellent and high rigid and stable mechanical properties are provided as described above, which is suitable to decrease the weight of the vehicle parts. Accordingly, the present invention can be used for undercarriage including a knuckle, a suspension arm and brake caliper and engine parts including a crank shaft, cam shaft and piston ring. In particular, when the present invention is applied to the engine parts rotating at high speed and parts adjacent to tires among the vehicle parts, not only the weight is decreased, but also oscillation and noise characteristics can be improved.

Example 1

A Fe—Si—Mg based molten metal was melted using a high frequency electric furnace. About 1.0 mass % of spheroidizing agent (Fe-45% Si-5% Mg) was added for spheroidization. Then, about 0.2 mass % of a ferrosilicon inoculant (Fe-75% Si) was added for inoculation. Thus, the composition shown in Table 1 was provided.

The molten metal was poured into a beta set mold 10 having cavities shown in FIG. 1. The mold was cooled to room temperature, and each molded product was taken out from the mold. A pouring temperature was set to 1400° C. The cavities of the beta set mold 10 were simulated for a thickness of a knuckle of the vehicle parts, and a plurality of round bars 3 each having a cross-sectional diameter of about 25 mm were disposed. In FIG. 1, a reference numeral 1 denotes a pouring gate, and a reference numeral 2 denotes a feeding head.

The resultant molded products were evaluated as follows: Tensile strength and elongation at fracture: Each round bar 3 of the molded products was cut, and a tensile test piece was produced by a turning process in accordance with JIS Z2241. The tensile test was performed in accordance with JIS Z2241 using the Amsler universal testing machine to measure the tensile strength and the elongate at fracture.

Young's modulus: A cube having 10 mm sides was cut out from the round bar 3 of the molded product, and its density was measured by the Archimedes method. A longitudinal wave sound speed and a transversal wave sound speed were measured by a ultrasonic pulse method. From these values, the Young's modulus was calculated. As a measurement apparatus for the ultrasonic pulse method, "digital ultrasonic flaw detector UI-25" (product name) manufactured by Ryoden Shonan Electronics Corporation was used. An oscillator for longitudinal and transverse waves manufactured by Eishin Kagaku Co., Ltd. was used.

Area ratio of concatenated structure of graphite: A fracture surface of the tensile test piece after the above-described tensile test was observed by a microscope, and an area ratio of the concatenated structure of graphite to a total area of the fracture surface was calculated. The microscope was KH-7700 manufactured by HYROX. CO., Ltd., and 20 to 160 magnifications zoom lens (model No. MX-2016Z by the same company) was used for capturing images. By a 2D (two dimensional) measuring function of the microscope, the area ratio was calculated by dividing the area of the concatenated structure of graphite by the total area of the fracture surface. A boundary between the concatenated structure of graphite and other structure was enlarged by the section (visual field) and was specified by visually inspecting concatenated parts of the graphite structure.

FIG. 2 shows a microscope image of the fracture surface of the tensile test piece. Black parts represent the concatenated structure of graphite where spheroidal graphite was linearly concatenated. FIG. 3 shows a schematic view clearly showing the concatenated structure of graphite shown in FIG. 2. Within the fracture surface 4, the concatenated structure of graphite 5 are found.

Rotary-bending fatigue test: In order to evaluate the relationship between the tensile strength and the elongation, a rotary-bending fatigue test was performed for some of Examples and Comparative Examples. Test pieces were No. 1 test pieces specified in JIS Z 2274 and were cut out from the round bar 3 of the molded product. The rotary-bending fatigue test was performed using Ono-type rotary-bending fatigue tester (model number of ORB-10B manufactured by TOKYO KOKI Co., Ltd.). The test conditions were: a rotating speed of 3000 rpm, a test cycle number of $10^7$, a bending stress of about 270 MPa (272.8 to 273.3 MPa) corresponding to fatigue strength of the FCD 600 material (spheroidal graphite cast iron product specified in JIS G5502). The test piece cracked or fractured was failed to the test. The test was performed 8 times per each Example and Comparative Example. The numbers of passes and fails were determined. When the fail number is one or less, it regards stable mechanical properties.

TABLE 1

| | Component composition (mass %) | | | | | | | CE value | Area ratio of concatenated structure of | Elogation at fracture | Tensile strength | Young's modulus | Number of fails in rotary-bending |
|---|---|---|---|---|---|---|---|---|---|---|---|---|---|
| | C | Si | Mn | P | S | Cu | Mg | (%) | graphite (%) | (%) | (MPa) | (GPa) | fatigue test |
| Ex. 1 | 3.58 | 1.56 | 0.20 | 0.038 | 0.013 | 0.02 | 0.034 | 4.10 | 0 | 11 | 602.9 | 174 | — |
| Ex. 2 | 3.13 | 2.52 | 0.21 | 0.033 | 0.009 | 0.04 | 0.031 | 3.97 | 0 | 23.1 | 529.2 | 175 | — |
| Ex. 3 | 3.14 | 2.21 | 0.20 | 0.034 | 0.010 | 0.04 | 0.030 | 3.88 | 0 | 17 | 571.5 | 175 | 0 |
| Ex. 4 | 3.22 | 1.54 | 0.21 | 0.041 | 0.012 | 0.02 | 0.035 | 3.73 | 45.6 | 9.7 | 637.2 | 177 | 1 |
| Ex. 5 | 2.60 | 1.74 | 0.24 | 0.030 | 0.010 | 0.02 | 0.033 | 3.18 | 0 | 6.8 | 685.2 | 181 | — |
| Ex. 6 | 2.39 | 2.09 | 0.24 | 0.028 | 0.009 | 0.04 | 0.033 | 3.09 | 0 | 7.5 | 702.7 | 182 | 0 |
| Ex. 7 | 2.15 | 2.58 | 0.23 | 0.032 | 0.010 | 0.04 | 0.032 | 3.01 | 0 | 6.0 | 690.6 | 182 | — |
| Ex. 8 | 2.36 | 1.53 | 0.20 | 0.036 | 0.012 | 0.02 | 0.030 | 2.87 | 16.5 | 6.2 | 684.8 | 183 | — |
| Comp. Ex. 1 | 3.53 | 2.48 | 0.21 | 0.034 | 0.008 | 0.04 | 0.034 | 4.36 | 0 | 22.2 | 504.8 | 166 | — |
| Comp. Ex. 2 | 3.54 | 2.11 | 0.21 | 0.033 | 0.009 | 0.04 | 0.033 | 4.24 | 0 | 17.4 | 543.3 | 169 | — |
| Comp. Ex. 3 | 2.73 | 2.48 | 0.25 | 0.034 | 0.010 | 0.04 | 0.034 | 3.56 | 53.7 | 7.3 | 566.5 | 177 | — |
| Comp. Ex. 4 | 2.77 | 2.14 | 0.24 | 0.035 | 0.010 | 0.04 | 0.029 | 3.48 | 62.4 | 7.1 | 577.2 | 179 | — |
| Comp. Ex. 5 | 2.78 | 1.84 | 0.20 | 0.033 | 0.009 | 0.02 | 0.035 | 3.39 | 100 | 5.5 | 521.9 | 179 | 4 |
| Comp. Ex. 6 | 2.78 | 1.54 | 0.20 | 0.031 | 0.009 | 0.02 | 0.034 | 3.29 | 62.2 | 7.2 | 587.4 | 179 | 3 |

As shown in Table 1, in each Example satisfying that 2.0% to less than 2.7% of C is included and the CE is 2.8 to 3.2% or that more than 3.0% to less than 3.6% of C is included and the CE is 3.6 to 4.2%, the area ratio of the concatenated structure of graphite is 50% or less and the Young's modulus was increased to 170 GPa or more.

In each of Examples 3 and 6, the number of fails was 0 in the rotary-bending fatigue test. In Example 4, the number of fails was 1 in the rotary-bending fatigue test. These Examples were good. In Example 4, a micro crack was found in the failed product by the rotary-bending fatigue test.

In particular, in each of Examples 5 to 8 having a lower CE value (CE of 2.9 to 3.2%) than that in each of Examples 1 to 4, the Young's modulus is improved exceeding 180 GPa.

On the other hand, in each of Comparative Examples 1 and 2 having the CE of more than 4.2%, the concatenated structure of graphite were not generated, but the Young's modulus is decreased to less than 170 GPa, which results in a low rigidity.

In each of Comparative Examples 3 to 6 having 2.7% to 3.0% of C and the CE of more than 3.2% to less than 3.6%, the area ratio of the concatenated structure of graphite exceeds 50%. In each of Comparative Examples 5 and 6, which are typical comparative examples, the number of fails exceeds 1 in the rotary-bending fatigue test, and the mechanical properties became unstable. In Comparative Examples 5 and 6, the failed products in the rotary-bending fatigue test were fractured. It is contemplated that the concatenated structure of graphite becomes a starting point of fatigue fracture.

FIG. 4 is a graph showing a relationship between tensile strength and elongation in each of Examples and Comparative Examples. Filled circles represent Examples, and filled triangles represent Comparative Examples. Here, in each of Examples 1 to 8 and Comparative Examples 1 and 2, the number of fails in the rotary-bending fatigue test is one or less. However, in each of Comparative Examples 1 and 2, the Young's modulus is less than 170 GPa. Therefore, Comparative Examples 1 and 2 are excluded in FIG. 4 for calculation.

The line L (the mathematical expression (2)) was derived as follows: A slope of the line passing through the values in Examples 1 to 8 was determined using the least square method, thereby providing the slope of −0.09. Next, when the slope of the line passes through each value in Examples 1 to 8 and Comparative Examples 1 and 2, an y-intercept positioned at a lower left in FIG. 4 (=65) was determined, thereby provided the mathematical expression (2): 0.09×B+A>65.

As apparent from FIG. 4, in each of Comparative Examples 3 to 6 having the area ratio of the concatenated structure of graphite exceeding 50% and providing poor evaluation results in the rotary-bending fatigue test, it was found that the mathematical expression (2): 0.09×B+A>65 was not satisfied, and the balance between the tensile strength and the elongation was poor. In other words, in order to improve both of the tensile strength and the elongation, it is preferable that the area ratio of the concatenated structure of graphite is controlled to 50% or less.

In particular, in each of Examples 3 and 6 having the area ratio of the concatenated structure of graphite of 0%, the number of fails was 0 in the rotary-bending fatigue test, which was most excellent. It is desirable to limit the CE of 2.9 to 3.2% and the CE of 3.8 to 4.2%. The y-intercept is 68 in order to position the line having the above-described slope of −0.09 at an upper side in FIG. 4 as compared to the case of each of Examples 4 and 8 having no area ratio of the concatenated structure of graphite of 0%. When B×0.09×+A>68 is satisfied, the area ratio of the concatenated structure of graphite is 0%, which is more preferable as the balance between the tensile strength and the elongation is the best.

DESCRIPTION OF REFERENCE NUMERALS

4 Fracture surface of tensile test piece

5 Graphite concatenated structure

What is claimed is:

1. A spheroidal graphite cast iron, comprising:

2.0 mass % to less than 2.7 mass % or more than 3.0 mass % to less than 3.6 mass % of C, 1.53 mass % to 2.58 mass % of Si, 1.0 mass % or less and more than 0 mass % of Mn, 1.0 mass % or less and more than 0 mass % of Cu, 0.02 mass % to 0.07 mass % of Mg and residual Fe and inevitable impurities, wherein a carbon equivalent (a CE value) calculated by mathematical expression (1): CE=C (mass %)+Si (mass %)/3 in terms of C and Si contents is 2.8% to 3.2% within a first range from 2.0 mass % to less than 2.7 mass % of C and is 3.6% to 4.2% within a second range from more than 3.0 mass % to less than 3.6 mass % of C;

Young's modulus is 170 GPa or more;

an area ratio of concatenated structure of graphite is 50% or less; and the mathematical expression (2): 0.09×B+A>65 is satisfied, where A is % elongation at fracture and B is a tensile strength of 529.2 to 702.7 MPa.

2. The spheroidal graphite cast iron of claim 1, wherein the Young's modulus is 175 GPa or more.

3. The spheroidal graphite cast iron of claim 1, wherein CE is 2.9% to 3.2% when the spheroidal graphite cast iron comprises 2.0 mass % to less than 2.7 mass % of C.

4. The spheroidal graphite cast iron of claim 3, wherein no concatenated structure of graphite emerges.

5. The spheroidal graphite cast iron of claim 3, wherein the Young's modulus is 180 GPa or more.

6. The spheroidal graphite cast iron of claim 1, wherein CE is 3.8% to 4.2% when the spheroidal graphite cast iron comprises more than 3.0 mass % to less than 3.6 mass % of C.

7. The spheroidal graphite cast iron of claim 6, wherein no concatenated structure of graphite emerges.

8. The spheroidal graphite cast iron of claim 1, comprising 0.3 mass % or less and more than 0 mass % of Cu and 0.3 mass % or less and more than 0 mass % of Mn.

* * * * *